US006821491B1

(12) United States Patent
Brück et al.

(10) Patent No.: US 6,821,491 B1
(45) Date of Patent: Nov. 23, 2004

(54) MUFFLER AND ASSOCIATED ASSEMBLY HAVING A CATALYST CARRIER BODY AND A RETAINING ELEMENT AND METHOD FOR PRODUCING THE ASSEMBLY

(75) Inventors: Rolf Brück, Bergisch Gladbach (DE); Manfred Vierkötter, Neunkirchen-Seelscheid (DE); Johann Zehetner, Lohmar (DE)

(73) Assignee: EMITEC Gesellschaft fuer Emissionstechnologie GmbH, Lohmar (DE)

( * ) Notice: Subject to any disclaimer, the term of this patent is extended or adjusted under 35 U.S.C. 154(b) by 0 days.

(21) Appl. No.: 09/450,399

(22) Filed: Nov. 29, 1999

Related U.S. Application Data

(63) Continuation of application No. PCT/EP98/02969, filed on May 20, 1998.

(30) Foreign Application Priority Data

May 27, 1997 (DE) ..... 197 22 202

(51) Int. Cl.[7] ..... B01D 53/34; F01N 3/28
(52) U.S. Cl. ..... 422/180; 422/177
(58) Field of Search ..... 422/171–180, 422/211, 222; 60/299, 300

(56) References Cited

U.S. PATENT DOCUMENTS 4,050,903 A * 9/1977 Bailey et al. ..... 422/177
4,086,063 A * 4/1978 Garcea ..... 422/177
4,795,615 A 1/1989 Cyron et al. ..... 422/179
5,376,341 A * 12/1994 Gulati ..... 422/179

FOREIGN PATENT DOCUMENTS

| | | |
|---|---|---|
| DE | 27 46 475 A1 | 4/1979 |
| DE | 38 29 668 C2 | 12/1994 |
| EP | 0 470 113 B1 | 2/1993 |
| FR | 2 444 793 | 7/1980 |

OTHER PUBLICATIONS

International Patent Application WO 94/18441 (Bestenreiner et al.) Aug. 18, 1994.
International Patent Application WO 96/02741 (Karlsson), dated Feb. 1, 1996.

* cited by examiner

*Primary Examiner*—Hien Tran
(74) *Attorney, Agent, or Firm*—Laurence A. Greenberg; Werner H. Stemer; Gregory L. Mayback

(57) ABSTRACT

A muffler and an associated assembly for cleaning exhaust gas, especially from small engines, include a metal catalyst carrier body and a retaining element which is preferably built into a muffler casing. The catalyst carrier body has a plurality of inner flow paths and is mounted in an exhaust pipe. The retaining element has an opening which surrounds at least a part of a jacket surface of the catalyst carrier body and is directly secured thereto, so that the catalyst carrier body remains dimensionally stable and can be transported. The retaining element can be joined to the exhaust pipe casing which forms an inflow chamber and an outflow chamber in such a way that the retaining element seals and separates the two chambers from each other. Due to the use of the retaining element, no jacket tube is required for the catalyst carrier body which enables the carrier body to be built into a muffler casing both directly and easily. A method for producing the assembly is also provided.

11 Claims, 2 Drawing Sheets

MUFFLER AND ASSOCIATED ASSEMBLY HAVING A CATALYST CARRIER BODY AND A RETAINING ELEMENT AND METHOD FOR PRODUCING THE ASSEMBLY

CROSS-REFERENCE TO RELATED APPLICATION

This application is a continuation of copending International Application No. PCT/EP98/02969, filed May 20, 1998, which designated the United States.

BACKGROUND OF THE INVENTION

Field of the Invention

The invention relates to a muffler and an associated assembly having a metallic catalyst carrier body or support structure for exhaust gas cleaning or emission control, in particular of small engines. The invention also relates to a method for producing such an assembly.

Catalyst carrier bodies for exhaust gas cleaning which have retaining elements are known. Published French Patent Application 2 444 793 describes a carrier body in which metallic clamping bands are used for positionally fixing the catalyst carrier body assembly. However, the clamping bands are not intended for fastening to an exhaust pipe casing. Instead, as far as the exhaust pipe casing is concerned, portions have to be circumferentially formed onto the periphery of the catalyst carrier body in an additional operation. A special additional production apparatus is required for that purpose, in order to ensure that the carrier body is fastened in the exhaust pipe casing in a sealing manner.

German Patent DE 38 29 668 C2 describes an exhaust muffler for two-stroke engines with a mounting for a catalyst carrier body. In that case the mounting forms an exhaust space through the use of two profiled plates. On one hand, the catalyst carrier body is provided in a known way with a tubular jacket on which the plates are correspondingly supported and fastened. The plates are fastened on the catalyst carrier body provided with the tubular casing, in such a way that the structure as a whole points away from the supporting region but does not penetrate the latter. On the other hand, the profiled plates also include a part of the exhaust tail pipe, with the result that the production of such complicatedly profiled plates is cost-intensive and, in particular for catalytic converters of small engines, does not appear to be particularly suitable.

U.S. Pat. No. 4,795,615 describes a catalyst carrier body in which jacket clamping strips are provided for positional fixing in the exhaust pipe system. Although the jacket clamping strips ensure a positional fixing in the exhaust pipe casing, the catalyst carrier body must have further devices to allow it to be kept in a dimensionally stable state during transportation until it is installed into the exhaust pipe casing. European Patent 0 470 113 B1 describes a catalyst carrier body which has a tubular jacket to allow it to be transported in a dimensionally stable state to a location where it is installed into an exhaust pipe system. The tubular jacket has a circumferential bead on which a retaining plate can be fastened. That retaining plate serves for further fastening in the exhaust pipe casing of a unit including the retaining plate, the tubular jacket and the catalyst carrier body.

Furthermore, German Published, Non-Prosecuted Patent Application 27 46 475 describes a catalyst carrier body in which a tensioning band is placed around a carrier body.

Overlapping ends of the band are fastened on an inner periphery of the exhaust pipe casing. Although such a tensioning band serves the possibility of allowing the carrier bodies to be transported separately to the place where they are installed, fastening in the exhaust pipe casing in a mechanically stable manner, including with respect to vibration, is difficult to accomplish in that way. That is because the tensioning band is intended to take up thermal expansions and therefore cannot be connected entirely at its periphery to the exhaust pipe casing.

SUMMARY OF THE INVENTION

It is accordingly an object of the invention to provide an assembly which has a catalyst carrier body and a retaining element, can be transported in a dimensionally stable state, does not require a tubular casing, can be produced at low cost and can be easily adapted and fitted into an exhaust pipe casing, a corresponding muffler for installation of such assemblies and a method for producing an assembly, which overcome the hereinafore-mentioned disadvantages of the heretofore-known devices and methods of this general type.

With the foregoing and other objects in view there is provided, in accordance with the invention, an assembly for cleaning exhaust gas or emission control, in particular of a small engine, comprising a metallic catalyst carrier body without a tubular jacket for installation in an exhaust pipe casing, the catalyst carrier body having a longitudinal axis, an interior with a plurality of flow paths and a jacket surface; and at least one substantially plate-shaped retaining element to be fastened in the exhaust pipe casing, the retaining element having an opening formed therein for receiving and securing the catalyst carrier body, the retaining element having a protrusion, such as a flanging or a collar, surrounding only part of the jacket surface of the catalyst carrier body, in particular enclosing substantially the entire periphery, the retaining element fastened directly on the catalyst carrier body, and the retaining element holding the catalyst carrier body together in a dimensionally stable state and/or substantially supporting the catalyst carrier body on its own.

In accordance with another feature of the invention, the retaining element can be connected to the exhaust pipe or muffler casing, which has an inflow chamber for the exhaust-gas flow to be treated and an outflow chamber for the treated exhaust-gas flow, with the two chambers interconnected through the catalyst carrier body, in such a way that a first part of the carrier body faces the inflow chamber and a second part of the carrier body faces the outflow chamber, which is separated from the inflow chamber in a sealing manner. Preferably, the first and second parts of the carrier body are made to have approximately the same length. However, corresponding conditions for installing the catalyst carrier body into the exhaust pipe casing, particularly if the latter is a muffler casing, may necessitate distributions of length other than this. Since it is fastened directly on the carrier body, the retaining element serves for directly ensuring the dimensional stability of the catalyst carrier body once it has been produced. The form which is customary in the case of metallic honeycomb structures, obtained by laminating, winding or intertwining at least partially structured layers of sheet metal to form a honeycomb assembly, would not be dimensionally stabilized adequately if precautions were not taken to prevent the assembly from coming apart again. If a retaining element is pushed over the assembly once it has been produced, its dimensional stability is consequently ensured, with the result that the catalyst carrier body can be transported with the retaining element provided directly on it, without dimensional stability having to be accomplished through the use of a tubular jacket or auxiliary devices.

The retaining element is further constructed in such a way that it corresponds to the inner form of the exhaust pipe casing and thus also serves for direct fastening within the exhaust pipe casing. This fastening is configured in such a way that the exhaust pipe casing is reliably subdivided, in an essentially sealing manner, into an inflow chamber, into which the exhaust-gas flow to be treated enters, and an outflow chamber, into which the treated exhaust-gas flow enters from the catalyst carrier body. This provides a very low-cost component which, along with greater flexibility and adaptability to the widest variety of geometrical configurations of the exhaust pipe casing, additionally has the decisive advantage that the widest variety of types of catalyst carrier bodies can be used. For instance, radial catalysts, axial catalysts, i.e. honeycomb structures which can be flowed through essentially radially or axially, as well as so-called diagonal catalysts, can be readily used. Diagonal catalysts are to be understood as meaning those which have in the interior of the catalyst carrier body flow paths that have both a radial directional component and an axial directional component.

In accordance with a further feature of the invention, the retaining elements are constructed in the form of plates. In a preferred embodiment, the retaining element is configured as an essentially planar plate. The use of a planar plate is particularly advantageous, since a planar plate can be easily produced with an opening adapted to the form of the catalyst carrier body and can also be easily adapted to the inner form of the exhaust pipe casing.

In accordance with an added feature of the invention, the retaining element has an approximately elliptical opening for obliquely configuring a cross-sectionally round catalyst carrier body therein. A greater region of the periphery of the actual catalyst carrier body is retained in a dimensionally stable state because the carrier body is disposed obliquely in the retaining element. Furthermore, adaptation to given space conditions is easily possible.

In accordance with an additional feature of the invention, the opening of the retaining element has a collar at its rim. The collar may be produced by production processes which are known per se, such as drawing forming processes for example, when incorporating the opening. One of the purposes served by the collar is for better fastening and for ensuring better dimensional stability of the actual catalyst carrier body without a tubular jacket. Welding of the collar onto the catalyst carrier body is easier than welding into a collarless opening.

In accordance with yet another feature of the invention, in the case of elliptical openings, the rims on the narrow sides are flanged, with the result that an obliquely inserted catalyst carrier body bears on both sides against the flangings.

In accordance with yet a further feature of the invention, the provision of a retaining element allows the preferred use of a structure of an axial type, with a honeycomb structure, as the catalyst carrier body or, in a similarly preferred way, the use of a structure of a radial type, likewise with a honeycomb structure.

With the objects of the invention in view there is also provided a method for producing an assembly for cleaning exhaust gas, which comprises producing a catalyst carrier body with a longitudinal axis, an interior having a plurality of flow paths and an outer surface, but without a tubular jacket, in a production device, for installation of the catalyst carrier body into an exhaust pipe casing; producing at least one approximately plate-shaped retaining element having an opening formed therein and a protrusion in the vicinity of the opening in the form of a flanging or a collar; passing the completed catalyst carrier body directly from the production device into the opening with the protrusion surrounding only part of the outer surface of the catalyst carrier body; and fastening the protrusion directly on the outer surface of the catalyst carrier body, preferably by welding or by a form-lockingly connection, with the retaining element holding the catalyst carrier body together in a dimensionally stable state and/or substantially supporting the catalyst carrier body on its own. The carrier body is introduced directly from the production device into the opening provided in the retaining element after winding or laminating or intertwining at least partially structured layers of sheet metal.

The opening is preferably constructed in such a way that the longitudinal axis of the catalyst carrier body is inclined with respect to a direction substantially perpendicular to a plane identifying the extent of the retaining element. The retaining element is fastened directly to the outer surface of the catalyst carrier body in a sealing manner all the way around the periphery in the region of the opening. In other words, the actual catalyst carrier body has no tubular jacket. The catalyst carrier body which is produced by this method and provided with the retaining element can consequently be transported separately. The catalyst carrier body can be fitted into any desired forms of exhaust pipe casing according to the outer shaping of the retaining element, and can be fastened on or in the latter in such a way that the retaining element represents a baffle plate and subdivides the exhaust pipe casing into an inflow chamber for the exhaust gas to be treated and an outflow chamber for the treated exhaust gas.

In accordance with another mode of the invention, the catalyst carrier body is only wound, laminated or intertwined, in particular from layers of sheet metal already coated with ceramic and/or catalytically active material, at least in subregions, without the points of contact of a plurality of layers lying one on top of the other being brazed. Depending on the type of fastening of the retaining element to the layers of sheet metal, it may be necessary not to provide any coating at the connecting points, or to remove it again there. It may also be advisable to provide only some of the layers of sheet metal with catalytically active material, in order to keep the thermal loading caused by the exothermal conversion of exhaust gas constituents within limits.

In accordance with a further mode of the invention, the catalyst carrier body is produced from layers of sheet metal formed of expanded metal.

It is further preferred to wind or stack the catalyst carrier body from a foil assembly, with the result that the foil assembly can be brought into any desired form permitting the actual catalyst carrier body to be fitted into existing exhaust pipe casings according to the given design conditions. The catalyst carrier body preferably includes a foil with a corrugated structure obtained by arbitrary introduction into a space with inner dimensions and inner shapings which corresponds to the outer form of the actual catalyst carrier body. The foil having such a corrugated structure is, as it were, "fired" into a corresponding entry opening into such a space, with the result that a chaotically laminated catalyst carrier body is produced. The retaining element is preferably fitted as a dividing wall into an exhaust pipe casing and adhesively bonded there to the casing wall in a sealing manner, or is welded to the latter or curled with its border into a circumferential edge of the casing, with the result that two chambers interconnected through the catalyst carrier body are formed. In particular, a muffler casing with an obliquely fitted catalyst carrier body can be formed in this way.

With the objects of the invention in view, there is additionally provided a muffler for an exhaust system of a small engine, comprising a metallic catalyst carrier body with a jacket surface but without a tubular jacket; a muffler casing having an inflow chamber and an outflow chamber; and a dividing wall mutually separating the inflow and outflow chambers, the dividing wall constructed as an approximately plate-shaped retaining element for the catalyst carrier body, the dividing wall having an opening formed therein obliquely receiving the catalyst carrier body, the dividing wall having a protrusion, such as a flanging or a collar, at the opening surrounding only part of the jacket surface of the catalyst carrier body, and the protrusion fastened directly on the catalyst carrier body.

Other features which are considered as characteristic for the invention are set forth in the appended claims.

Although the invention is illustrated and described herein as embodied in a muffler and an associated assembly having a catalyst carrier body and a retaining element and a method for producing the assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
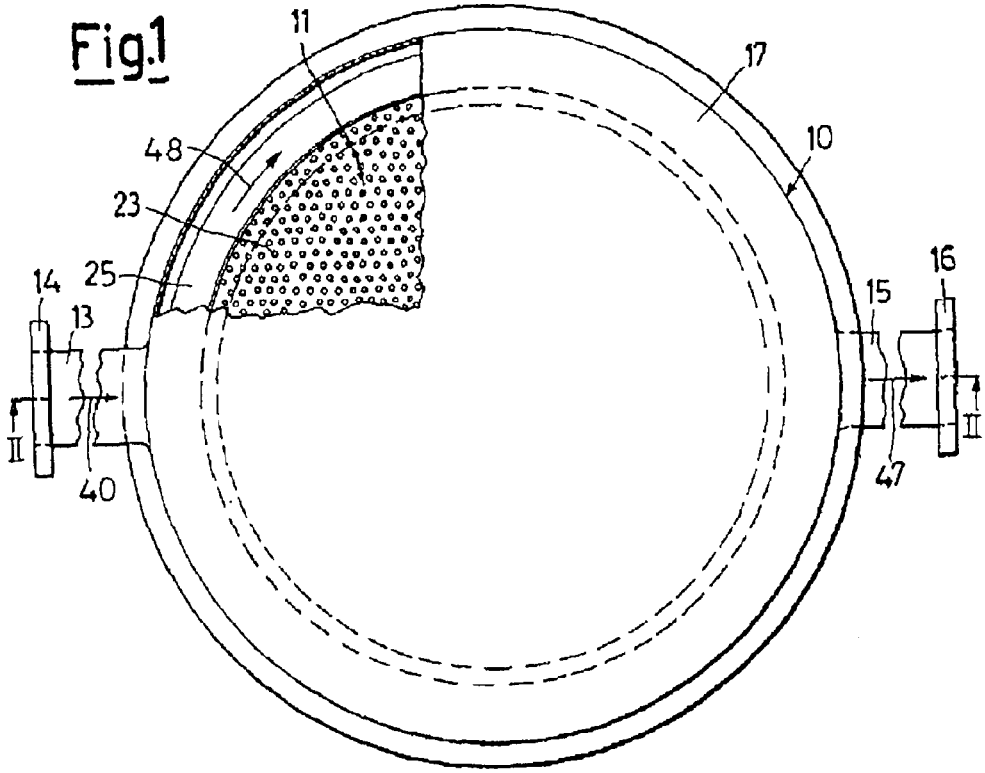
FIG. 1 is a diagrammatic, perspective view of a catalyst carrier body with a retaining element but without a tubular jacket.
Figure 2:
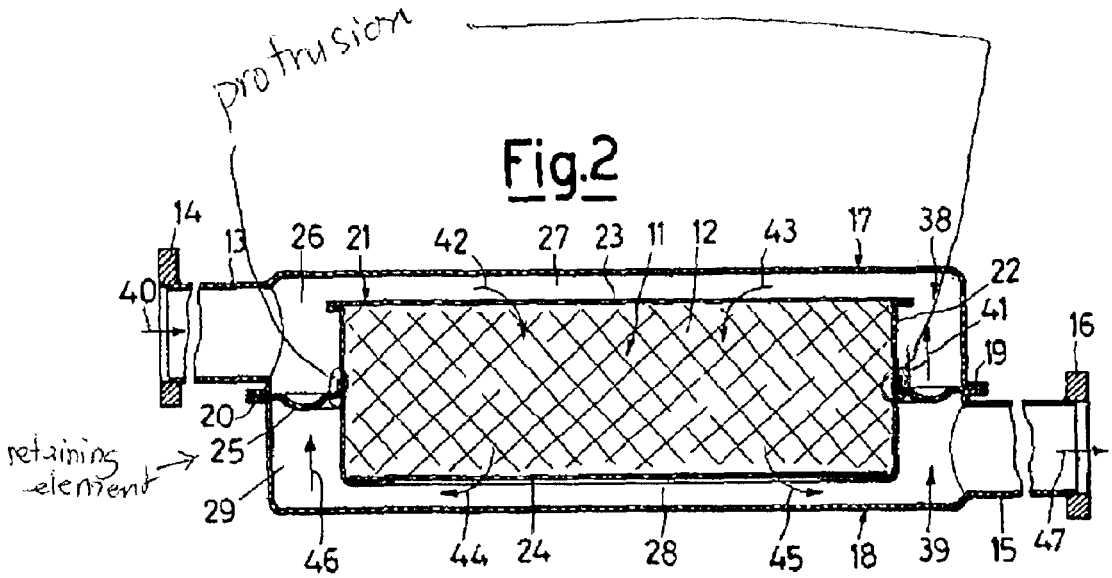
FIG. 2 is a fragmentary, sectional view of a basic configuration of a catalyst carrier body with a retaining element in an exhaust pipe casing.

Referring now to the figures of the drawings in detail and first, particularly, to FIG. 1 thereof, there is seen a catalyst carrier body or support structure 1 which is held by a retaining element 3 in an opening 4 provided in the retaining element 3 in such a way as to have an inclined longitudinal axis 2. The retaining element 3 has a planar structure and has a rectangular form, which is intended for fitting into an exhaust pipe casing 6 having an essentially rectangular structure as shown in FIG. 2. The opening 4 in the retaining element 3 has an elliptical structure in order to ensure that the cross-sectionally round catalyst carrier body 1 can be held obliquely in the retaining element 3. In order to provide better fastening of the inner periphery of the opening 4 of the retaining element 3 to the outer periphery of the catalyst carrier body 1, the retaining element 3 may be provided with a protrusion in the form of a collar, rim or flanging 5 at the periphery of the opening 4. The collar, rim or flanging 5 is connected directly to the catalyst carrier body 1 by a joining technique, in particular by a weld 13 or by a form-locking connection. A form-locking connection is one which connects two elements together due to the shape of the elements themselves, as opposed to a force-locking connection, which locks the elements together by force external to the elements. The catalyst carrier body 1 consequently forms a unit with the retaining element 3 which can be transported. This ensures that, once winding, laminating and/or intertwining of the catalyst carrier body 1 has taken place, the latter retains its form and does not unintentionally come apart again of its own accord or spring back from a compact form into a non-compact, loose form. The catalyst carrier body 1 is constructed substantially of at least partially structured layers of sheet metal 15 being wound, laminated and/or intertwined with one another to form channels 14 through which exhaust gas can flow.

The oblique configuration of the catalyst carrier body in the retaining element 3 has the advantage of ensuring that the height of the exhaust pipe casing 6 can be dimensioned to be less than in the case of a vertically fitted catalyst carrier body 1. Furthermore, it is possible to support edges of the catalyst carrier body 1 on an upper part 7 of the casing and/or a lower part 8 of the casing. That reduces the tendency of the system to vibrate and can facilitate assembly.

The basic configuration of a catalyst carrier body 1 according to the invention in an exhaust pipe casing 6 is represented in FIG. 2. The exhaust pipe casing 6 includes the upper part 7 of the casing which encloses an inflow chamber 10 and into which an exhaust inlet 9 opens, and the lower part 8 of the casing which encloses an outflow chamber 11 and from which treated gas exits through an exhaust outlet 12. The catalyst carrier body 1 is held in the retaining element 3 which is in the form of a planar plate. The retaining element 3 has outer dimensions which are adapted to inner dimensions of the exhaust pipe casing 6 formed by the upper part 7 and the lower part 8 of the casing. In this case the retaining element 3 is connected to the catalyst carrier body 1 in the opening 4 in a secure and essentially sealing manner. The retaining element 3 is also connected to an inner surface of the exhaust pipe casing 6 in a secure and essentially sealing manner. As a result, the retaining element 3 serves as a dividing wall between the inflow chamber 10 and the outflow chamber 11. The exhaust-gas flow is repeatedly deflected in the exhaust pipe casing, so that good muffling is also achieved.

The oblique configuration of the catalyst carrier body 1 in the exhaust pipe casing 6 has the effect of ensuring a relatively large outer inflow surface area for the exhaust-gas stream entering the catalyst carrier body 1.

Figure 3:
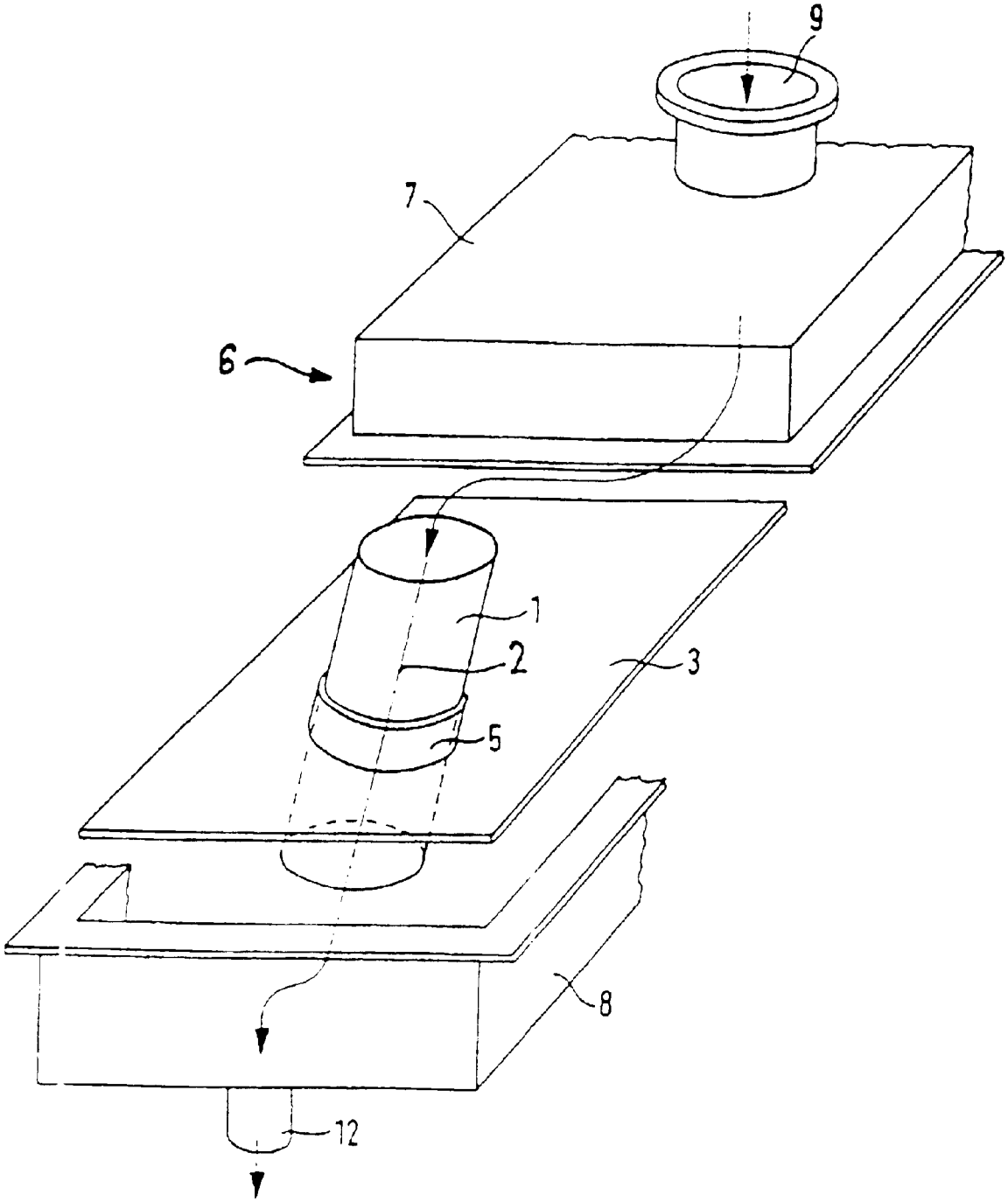
FIG. 3 is a fragmentary, exploded, perspective view showing the catalyst carrier body with the retaining element fitting into a muffler casing according to an exemplary embodiment of the invention.

FIG. 3 shows how a catalyst carrier body 1 without a tubular jacket is provided according to the invention with a retaining element 3 having a rectangular and essentially planar structure. In this case the outer form of the retaining element 3 is shaped in such a way that the casing parts or halves 7, 8, which form the exhaust pipe casing 6 and have a peripheral flanged border, connect the plate between their flanged borders circumferentially relative to the casing. This connection is performed by a corresponding flanging operation, welding operation or similar known connecting operation to form a unitary exhaust pipe casing 6. As a result, the catalyst carrier body 1 is securely disposed in the interior of the exhaust pipe casing 6 with an inclined longitudinal axis 2, as is represented in FIG. 3. In this case the exhaust-gas flow passes through the exhaust inlet 9 into the inflow chamber 10, which is formed by the upper part 7 of the casing and the retaining element 3. Once it has passed through, and consequently once it has been treated in the catalyst carrier body 1, the treated exhaust-gas flow exits the exhaust pipe casing 6 through the outlet chamber 11 and the exhaust outlet 12.

The catalyst carrier body 1 according to the invention, with the retaining element 3, consequently provides a catalytic converter which can be adapted to a wide variety of installation configurations and has a low-cost production, in particular for use for small engines. It may be constructed in particular from layers of precoated sheet metal and can be transported without additional elements and without a tubular jacket. As a result, the production of the catalyst carrier body and the installation into a muffler can take place at different locations, without additional production steps or transport securing measures being required.

We claim:

1. An assembly for cleaning exhaust gas, comprising:

a metallic catalyst carrier body without a tubular jacket for installation in an exhaust pipe casing, said catalyst carrier body having a longitudinal axis, an interior with a plurality of flow paths and an outer surface; and a substantially plate-shaped retaining element to be fastened in said exhaust pipe casing, said retaining element extending in a plane, said plane including an angle with said longitudinal axis of said catalyst carrier body, said retaining element having an opening formed therein for receiving said catalyst carrier body and a protrusion formed at said opening securing said catalyst carrier body in said opening, said protrusion surrounding only a part of said outer surface of said catalyst carrier body, said retaining element fastened directly on said catalyst carrier body, and said retaining element at least one of holding said catalyst carrier body together in a dimensionally stable state and substantially supporting said catalyst carrier body on its own.

2. The assembly according to claim 1, wherein said catalyst carrier body has first and second parts, the exhaust pipe casing has an inflow chamber for exhaust gas to be treated and an outflow chamber for treated exhaust gas, and said retaining element is to be connected to said exhaust pipe casing for causing said first part of said catalyst carrier body to face said inflow chamber and said second part of said catalyst carrier body to face said outflow chamber, said chambers being substantially sealingly separated from one another permitting the exhaust gas to flow through said catalyst carrier body from said inflow chamber into said outflow chamber.

3. The assembly according to claim 2, wherein said exhaust pipe casing is disposed within a muffler casing.

4. The assembly according to claim 1, wherein said retaining element is a substantially planar plate having two sides, and said catalyst carrier body protrudes substantially to the same extent from both of said sides of said plate.

5. The assembly according to claim 1, wherein said catalyst carrier body has a round cross section, and said opening in said retaining element has an elliptical structure for obliquely configuring said catalyst carrier body in said opening.

6. The assembly according to claim 1, wherein said retaining element has a rim at said opening and said protrusion is a collar disposed at least in subregions at said rim for fastening said catalyst carrier body.

7. The assembly according to claim 5, wherein said elliptical opening has two long sides and two short sides, and said protrusion includes a flanged subregion at each of said short sides of said elliptical opening.

8. The assembly according to claim 7, wherein said flanged subregions are flanged toward different sides of said retaining element at an obtuse angle and bear against said obliquely inserted catalyst carrier body.

9. The assembly according to claim 1, wherein said catalyst carrier body is a honeycomb structure for receiving an axial flow.

10. The assembly according to claim 1, wherein said catalyst carrier body is constructed substantially of at least partially structured layers of sheet metal being at least one of wound, laminated and intertwined with one another to form channels for said plurality of flow paths.

11. The assembly according to claim 10, wherein said layers of sheet metal are coated with catalytically active material.

* * * * *